US005479855A

United States Patent [19]

Christoph et al.

[11] Patent Number: 5,479,855

[45] Date of Patent: Jan. 2, 1996

[54] BELT-TYPE PRINTING MACHINE FOR MULTI-COLOR PURPOSES

[75] Inventors: Michael Christoph, Clausthal-Zellerfeld; Udo Welschlau; Wolfgang Becker, both of Northeim, all of Germany

[73] Assignee: Thimm Verpackung GmbH & Co., Northeim, Germany

[21] Appl. No.: 408,684

[22] Filed: Mar. 21, 1995

[30] Foreign Application Priority Data

Mar. 24, 1994 [DE] Germany ..... 44 10 132.5

[51] Int. Cl.[6] ..... B41F 5/16

[52] U.S. Cl. ..... 101/174; 101/178; 101/219; 101/DIG. 42; 101/DIG. 43

[58] Field of Search ..... 101/174, 177, 101/178, 136, 138, 153, 212, 218, 219, 225, 170, 253, DIG. 42, DIG. 43

[56] References Cited

U.S. PATENT DOCUMENTS

| | | | |
|---|---|---|---|
| 3,252,415 | 5/1966 | Crawford | 101/219 |
| 3,452,261 | 6/1969 | Tagliasacchi | 101/181 |
| 4,214,525 | 7/1980 | Aaron | 101/181 |
| 4,817,525 | 4/1989 | Yagi | 101/219 |
| 4,893,559 | 1/1990 | Sillars | 101/178 |
| 4,911,073 | 3/1990 | Sillars | 101/181 |
| 5,003,873 | 4/1991 | Lauber | 101/219 |
| 5,377,589 | 1/1995 | Krüger et al. | 101/24 |

FOREIGN PATENT DOCUMENTS

| | | |
|---|---|---|
| 018147 | 4/1980 | European Pat. Off. . |
| 0308367 | 8/1988 | European Pat. Off. . |
| 4100871 | 1/1991 | Germany . |

*Primary Examiner*—Eugene H. Eickholt
*Attorney, Agent, or Firm*—Hopkins & Thomas

[57] ABSTRACT

A belt-type printing machine, especially for a plurality of colors, comprising at least one printing station (2) containing a frame (1), idler rolls (7) arranged in bearings therein, an impression cylinder (6) for guiding a continuous web (8) to be printed arranged in preferably fixed bearings on the frame (1), a plate cylinder (3), two sprocket wheels (4, 5) coaxially mounted to but not commonly driven with the plate cylinder (3) and at least one tensioning cylinder (10), around which an endless belt (11) extends having at least one flexible printing plate and being provided with perforations for the sprocket wheels (4, 5), wherein an inking assembly (13) allocated to the flexible printing plate of the belt (11), a drive acting upon the sprocket wheels (4, 5) to the belt (11) and an additional single drive (32) acting upon the plate cylinder (3) to the belt (11) for the purpose of avoiding the jump movement between the perforations of the belt and the pins of the sprocket wheels are provided. The two sprocket wheels (4, 5) are idler rollers against each other. The drive of the sprocket wheels (4, 5) is divided into two separately controllable partial drives (18, 24). Measuring devices (21, 27, 22, 28) for determining the instantaneous angular positions of the two sprocket wheels (5, 4) against each other and the instantaneous driving torques of the two partial drives (18, 24) are provided, and controlling means (37) for the controlling of driving torques equal to each other via the two partial drives (18, 24) to the sprocket wheels (5, 4) each and, in case of overriding a limit of these equal driving torques, of an additional torque adapted to the amount of overriding and to be transmitted by the additional single drive (32) of the plate cylinder (3) to the endless belt (11).

9 Claims, 5 Drawing Sheets

BELT-TYPE PRINTING MACHINE FOR MULTI-COLOR PURPOSES

FIELD OF THE INVENTION

The invention relates to a belt-type printing machine for use with a plurality of colors, which comprises at least one printing station containing a frame, idler rolls supported in bearings therein, an impression cylinder for guiding a continuous web to be printed, the web preferably being supported in fixed bearings on the frame, a plate cylinder, two sprocket wheels coaxially mounted with, but not driven with, the plate cylinder, and at least one tensioning cylinder around which an endless belt extends having at least one flexible printing plate, the belt being provided with perforations for the sprocket wheels, wherein an inking assembly allocated to the flexible printing plate of the belt, a drive acting upon the sprocket wheels, and an additional single drive acting upon the plate cylinder to the belt are provided. Such belt-type printing machines are typically used in the production of packaging material, in which the continuous web to be printed may consist of paper, board, aluminum foil, plastic foil or the like. A belt-type printing machine of this kind contains at least one printing station for each color.

BACKGROUND OF THE INVENTION

A belt-type printing machine of the kind mentioned above is known from EP 0 018 147 B1. The continuous web to be printed is guided over idler rolls supported on the frame of the machine and over an impression cylinder, one for each printing station. It is the impression cylinder, which is displaceably mounted on the frame to start printing, which is disadvantageous for the tensioning relations of the web, but is advantageous for the possibility to mount the unit of the plate cylinder and the sprocket wheels in bearings being fixedly positioned on the frame of the machine. Opposite the impression cylinder of this unit is a plate cylinder and two sprocket wheels, with their axes coaxial with the plate cylinder, mounted in fixed bearings. The plate cylinder may rotate independently of the two sprocket wheels, but the two sprocket wheels are mechanically connected to each other and rotate together. An endless belt extends around this unit, which is provided with at least one, but often with a plurality of, flexible printing plates. A first drive with positive engagement is allocated to the belt, which acts upon the two sprocket wheels to the belt. The sprocket wheels are connected in rotation to each other and the pins of the sprocket wheels engage into the perforations provided in the belt to maintain accurate registration during printing. In the travel of the flexible printing plates on the belt through the nip between the plate cylinder and the impression cylinder, and the web, respectively, a squeezing and a bulge occurs in the flexible material of the printing plates and thus a high drag or resistance to movement of the printing belt results directed opposite to the running direction. This resistance force, which may be called a force against the change of the shape of the printing plates, only exists in the printing process, but not when there is a distance between the web and the printing plates within the idler running of the machine, when printing is not performed. This resistance varies dependent on the shape of the printing plates running through the nip. This resistance force during the printing process may be higher, or become higher than the drive forces, which may be transmitted by the sprocket wheels to the belt and thus higher than the maximum force allowable between the pins of the sprocket wheels and the perforations of the belt. In such a case, one perforation will jump from one pin of the sprocket wheel to the next, and registration will be lost and the printed web cannot be used to obtain a proper printing result. To solve this problem the known belt-type printing machine provides an additional drive, a frictional drive in addition to the drive torque with positive engagement transmitted by the sprocket wheels to the belt. This additional frictional drive acts upon the plate cylinder to the belt. The plate cylinder may rotate independant from the sprocket wheels. The resistance force directed opposite to the running direction only occurs during the printing process at a printing plate, when the printing plate passes the nip. Very often there is not only one printing plate on the belt, but a plurality of plates with distances between each other. Thus during the running of the belt times arise in which the resistance force disappears. Even when a printing plate on the belt is passing the nip the resistance force varies. The amount of the resistance force depends on the amount of the area of the printing plate contacting the nip. To accomodate the varying resistance force the known belt-type printing machine is provided with a very complicated controlling means. This controlling means comprises sensors for continuously detecting a signal being proportional to the resistance force and occurring in the drive of the sprocket wheels. The generated data of this signal must be transmitted via a slip ring contact. The sensors use strain gauges to measure forces and torques. In addition, the controlling means comprises a clutch and a brake, which belong to a controlling loop and by which the additional drive to the plate cylinder is controlled. The additional drive is split from the main drive of the printing machine. In this known belt-type printing machine the sprocket wheels and the plate cylinder are used for driving purposes. The drive commonly acts upon the sprocket wheels to the belt. The additional drive acts upon the plate cylinder to the belt. It is disadvantageous and not easy to transmitt the drive on the one hand, and the additional drive on the other hand, to the sprocket wheels and the plate cylinder when they are in a coaxial and restricted arrangement. In addition, the sensitive parts, and especially the sensors (load cells) of the controlling means, are located in an area of the belt-type printing machine in which they are exposed to cleaning water and other detergents, and to colors inks also. The mechanical fixing of the two sprocket wheels to each other via the common drive is subject to wear. This is a negative for proper registration.

From EP 0 308 367 A1 a belt-type printing machine is known, in which the impression cylinder is mounted in fixed position in the frame of the machine. Thus there is the advantage that the tensioning conditions of the web to be printed do not vary when the belt with the printing plates is brought into contact with the web. But the plate cylinder must be mounted displaceably in the frame of the machine. The bearings of the plate cylinder have to be mounted displaceably in at least two directions, and the bearings of the tensioning roll in at least one direction. One drive for the tensioning roll and another drive for the plate cylinder has to be provided. It is not described whether and how the two drives are adapted to each other. In addition, a main drive is provided for driving the impression cylinder. DE 41 00 871 A1 shows a belt-type printing machine having an impression cylinder, which is mounted in fixed position on the frame of the machine. Complicated controlling means are avoided and the drive acting on the sprocket wheels is adapted to an additional drive to the belt. The additional drive acts on the tensioning roll to the belt. The plate cylinder is an idler roller having no drive. A controlling device is provided for the additional drive to transmitt an additional force to the belt in such a manner so that this force, one the one hand, during printing is higher than the difference between the resistance force directed opposite to the running direction when a printing plate runs through the nip between the web and the plate cylinder and the maximum force transmitted by the sprocket wheels to the belt, and on the other hand, so that this force during non-printing must be lower than the maximum force transmitted by the sprocket wheels to the belt.

In a number of cases the printing plate on the belt is not located symmetrically with respect to the vertical main plane extending in the direction of the printing machine. Thus, different loads result for the perforations on one side of the machine, compared to the perforations on the other side of the machine. The sprocket wheel on the one side of the machine transmits a greater amount of the drive torque than the sprocket wheel on the other side of the machine to comply with the different parts of the resistance force at the left and the right side of the machine. The fact that the belt containing the printing plates is a quasielastic body results in the disadvantage that unequal loads and unequal drives lead to different angular positions of the belt at the right side and at the left side of the machine. Thus registration at the right side is different from registration on the left side. Consequently different conditions (pressure on the face of a hole) in the area of the right and left perforations may occur. Unequal wear is also generated, making the problems even greater. This may lead to a situation in which the perforations of the belt on its more loaded side will jump against its sprocket wheel so that the printing result cannot be used, and is rejected.

SUMMARY OF THE INVENTION

It is the object of this invention to provide a belt-type printing machine of the kind mentioned above containing at least one printing station, but preferably a plurality of printing stations, to print in a multi-color process, making it possible to print an inline web using several printing stations with increased registration, but without the danger of the perforations of the belt jumping over the pins of the sprocket wheels.

In this invention this object is achieved by providing a belt-type printing machine of the described art, wherein the two sprocket wheels are idler rollers with respect to each other, the drive of the sprocket wheels is divided into two separately controllable partial drives, measuring devices for determining the instantaneous angular positions of the two sprocket wheels against each other and the instantaneous driving torques of the two partial drives are provided, and controlling means are provided for making the driving torques equal to each other via the two partial drives for each of the sprocket wheels and, in the event of overriding a limit of these equal driving torques, an additional torque adapted to the amount of the override limit is transmitted by the additional drive of the plate cylinder to the endless belt.

The invention starts with the idea to transmit substantially equal parts of the drive via the two sprocket wheels to the belt. As soon as the driving torque transmitted via the one sprocket due to a different resistance force generated by asymmetric arrangement increases and the driving torque transmitted via the other sprocket wheel decreases, a control device is effected so that the higher torque is decreased and the lower torque is increased to restore substantially equal torques having approximately the same value to the sprocket wheels as quickly as possible. This equal value will vary over the path of a printing plate through the nip and thus will increase and decrease with time. The entire drive torque to be transmitted by the sprocket wheels is split into two parts. Thus each part of the entire torque increases or decreases only for half of the entire amount. This results in the advantage that the limit, at which the sprocket wheels jump the perforations during increase in resistance force occurs much later. The danger of jumping is substantially decreased. It is a requirement for this method that the two sprocket wheels are no longer mechanically connected to each other, but that two separately controllable drives are provided, each allocated to one of the sprocket wheels. The instantaneous angular positions of the two sprocket wheels are monitored continuously by the measuring device. A resistance force generated asymmetrically to the vertical plane in the longitudinal direction of the running path of the web will result in a deviation of the instantaneous angular positions of the two sprocket wheels with respect to each other. This would lead to different driving torques of the two partial drives. The controlling means effects a contrary directed action up to the point at which the two partial driving torques of the sprocket wheels are the same. The printing plate fixed on the belt is a quasielastic body and this makes the controlling movement possible. Equal loads result in the area of the perforations at the left and right sprocket wheels. The pressure on the face of a left and right perforation is equal, and the wear generated is divided evenly, resulting in a substantially longer lifetime of the belt containing the printing plates. It is significant that the registration is improved also. Deviations in the angular positions of the left and right perforations are evened out and constantly compensated so that a negative effect to registration and to the printed web is avoided. A better printing quality results. A security margin is maintained by the fact that the pressure on the face of a perforation hole with respect to a limit of the driving torques is not surpassed by the use of an additional torque adapted to the instantaneous conditions transmitted by the additional single drive acting upon the plate cylinder to the belt.

The two partial drives may be connected to each other by an electric shaft for the purpose of synchronizing the instantaneous angular positions of the sprocket wheels. An electric shaft is a known element in the printing industry. By this the two sprocket wheels rotate in synchronization to each other. Advantageously a mechanical connection between the two sprocket wheels is avoided.

The two partial drives each may comprise an electric motor, with which a shaft encoder being a part of the measuring devices connected to the sprocket wheels for detecting the instantaneous angular positions of the two sprocket wheels. These electric motors preferably are digital single drives digitally controlled. There is the possibility to connect the motors of several printing stations to each other by electric shafts and thus rotate the sprocket wheels in synchronization with respect to the same angular positions. The concept of the new drive eliminates the complicated system susceptible to trouble as known in the prior art. Using the new measuring device the instantaneous driving torques of the sprocket wheels are measured by a single decive each, which directly detects the instantaneous current consumption of the two electric motors. The current consumption is proportional to the driving torque and may be measured directly and used for controlling purpose. Each driving torque is the partial torque which may be transmitted via the sprocket wheel to each of the perforations of the belt. The controlling means is digitally constructed. It controls the electric motor for the right sprocket wheel and the electric motor for the left sprocket wheel with respect to their angular positions to each other up to the point at which an equal split of the torques between the two sprocket wheels results.

One of the two partial drives for the two sprocket wheels may be provided as a leading drive for the controlling means and the other partial drive is a follower drive. When deviations occur both drives are directed contrary to each other. It does not matter which one of the drives is used as the leading drive and which as the follower drive. But is is advantageous to use the drive located coaxially with the common axle of the plate cylinder and the sprocket wheels as the leading drive to have a short driving path as the leading drive.

The additional single drive for the plate cylinder is coaxially mounted to the common axis of the sprocket wheels and the plate cylinder and comprises an electric motor, to which an encoder, as a part of the measuring device, is connected, and the partial drive serving as a follower drive is mounted in parallel spaced apart from the common axis of the sprocket wheels and the plate cylinder. It is possible to change the location of the additional single drive and of the follower drive so that they are located on the same side of the machine to have an extremly quick acting possibility for the additional single drive, which serves to prevent the slitting of the sprocket wheels. So it is advantageous to locate the additional single drive coaxially to the sprocket wheels and to use an additional transmission gear to bridge the distance between the parallel axles.

The plate cylinder and/or the tensioning cylinder may be made out of carbon fiber material to decrease the diameter and the mass moment of inertia. Thus the mass moment of inertia is reduced by about 80%, which is the basis for quick controlling movements. The reduction in the diameter results in a decrease in the minimum length of the belt and thus, in a number of cases, to a reduction of cost for the printing plates used in the running direction of the belt.

For use with a plurality of printing stations a controlling means of a higher order may be provided, in which the encoders of the partial drives serving as the leading drives of the printing stations, the encoders of the partial drives serving as follower drives of the printing stations, and the encoders of the additional single drives of the printing stations are connected to one another.

BRIEF DESCRIPTION OF THE DRAWINGS

A preferred embodiment of the invention is described in detail in connection with the drawings, which show in.

DETAILED DESCRIPTION

Figure 1:
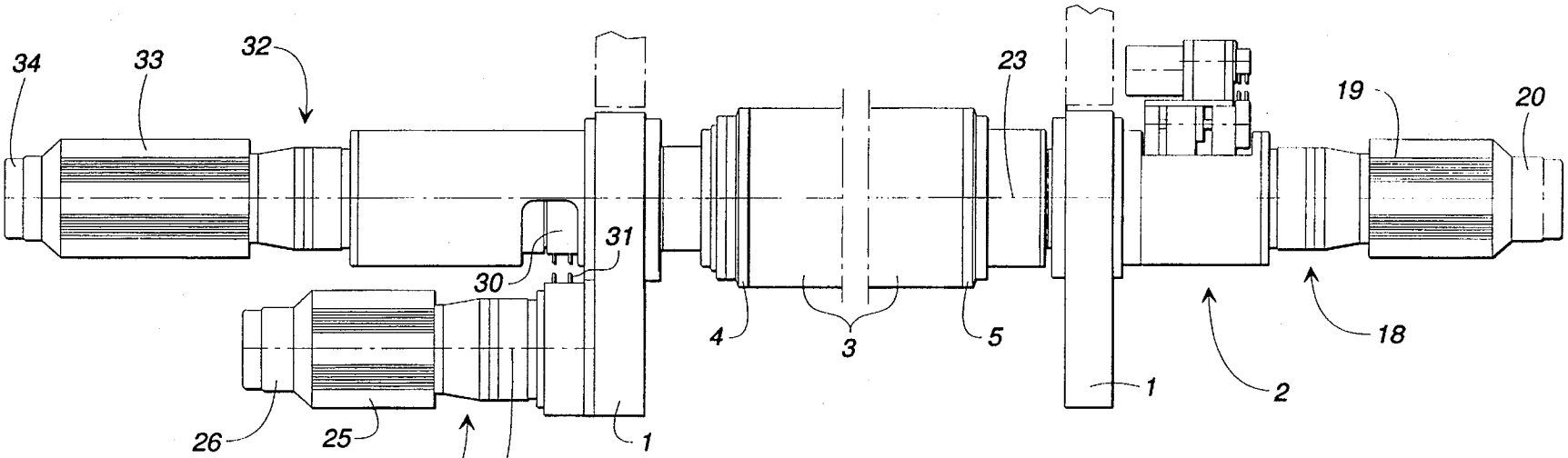
FIG. 1 the essential parts of a preferred embodiment of a printing station, partially in section, FIG. 2 the right side of the belt drive arrangement of FIG. 1 in larger scale, FIG. 3 the left side of the belt drive arrangement of FIG. 1 in larger scale, FIG. 4 a vertical cross section through the belt drive arrangement of FIG. 1, and FIG. 5 the essential elements of a controlling means of a printing station and of a belt-type printing machine.
Figure 2:
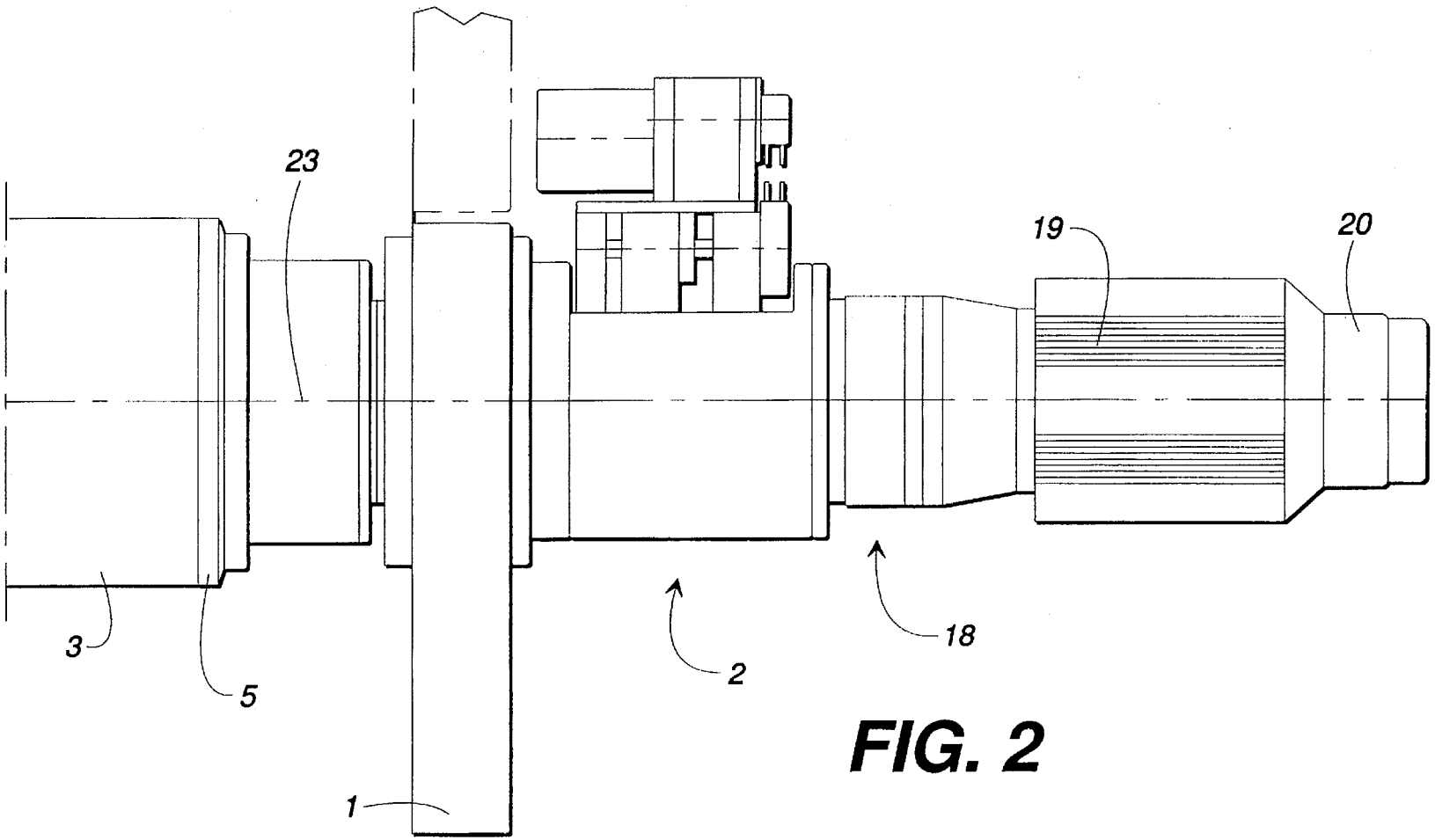

FIG. 1 schematically shows a frame 1 of a printing station 2. A plate cylinder 3 is pivotally supported on bearings which are displaceably mounted for working purposes. The plate cylinder 3 has a width according to the working width of the printing station and the belt-type printing machine. A sprocket wheel 4 is provided to the left of the plate cylinder 3, and a sprocket wheel 5 to the right to the plate cylinder 3. The sprocket wheels 4 and 5 may rotate against each other and against the plate cylinder 3.

Figure 4:
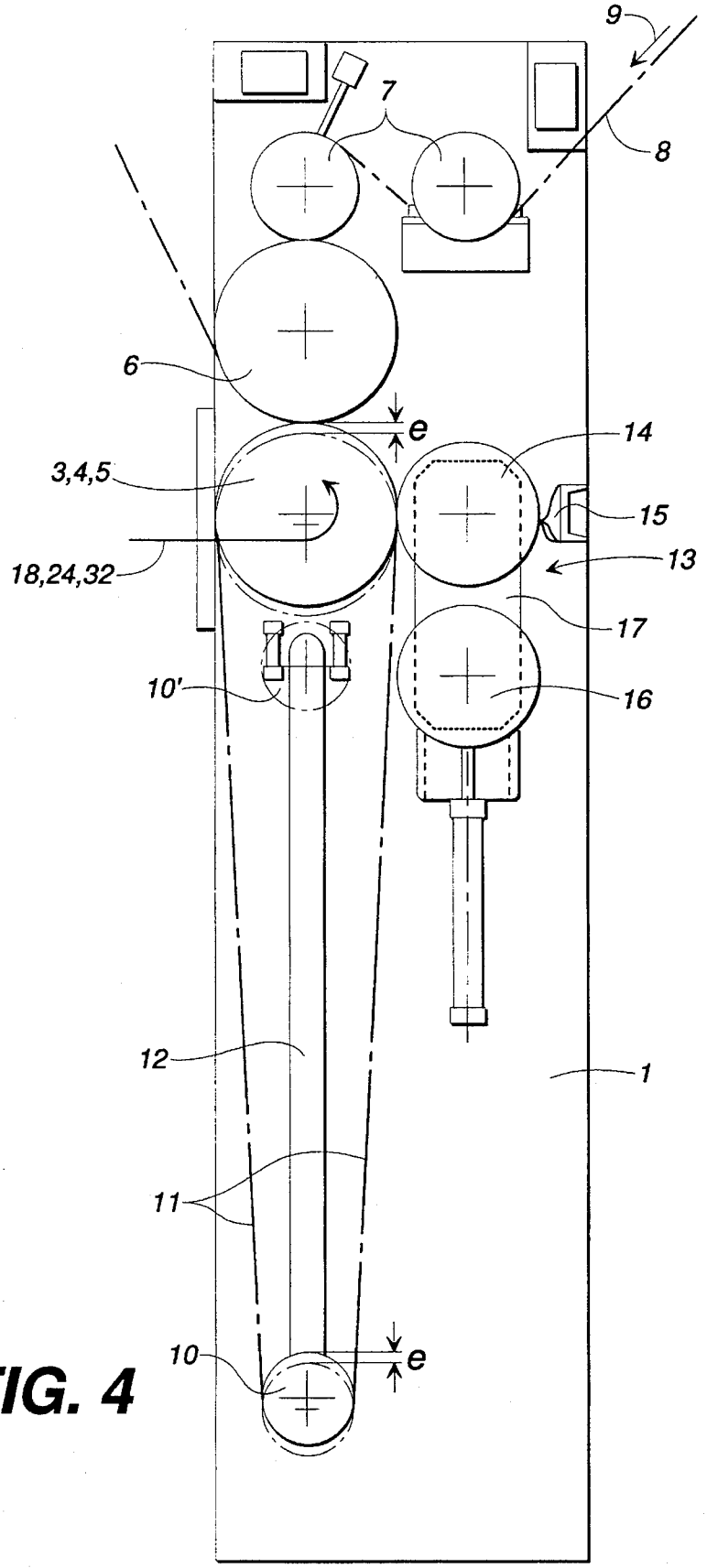

As seen from FIG. 4, an impression cylinder 6 is positioned with respect to the plate cylinder 3, the impression cylinder 6 is supported in bearings, which are fixed to the frame 1. A continuous web 8 to be printed runs over idler rolls 7 and the impression cylinder 6 of the printing station in the direction of arrow 9. A tensioning roll 10 is provided for the plate cylinder 3 and the sprocket wheels 4 and 5. A belt 11 extends around, on the one hand, sprocket wheels 4 and 5, and on the other hand the plate cylinder 3, the belt being provided with one or a plurality of printing plates. Depending on the length of the endless belt 11, the tensioning roll 10 is adjustably and displaceably supported at a distance with respect to the plate cylinder 3. The tensioning cylinder 10' is illustrated in dotted lines according to the minimum length of the endless belt. Impression cylinder 6 is preferably placed in a fixed position on frame 1, the unit of plate cylinder 3, sprocket wheels 4 and 5, and tensioning cylinder 10 being held by a supporting arrangement 12 and displaceably mounted within the space designated e for starting the printing. Each printing station comprises an inking assembly 13 containing a screen roll 14 and a doctor blade 15. A second screen roll 16 may be provided on a pivoting arm 17.

A partial drive 18 is allocated to the sprocket wheel 5, positioned for example at the right side, which may be switched and controlled separately. This partial drive 18 serves only to drive the sprocket wheel 5. The partial drive 18 comprises a motor 19 and an encoder 20, monitoring the angular position of the sprocket wheel 5. The encoder 20 is part of a measuring device 21 for determining the instantaneous angular position of the sprocket wheel 5. In addition, there is a measuring device 22 for determining the instantaneous driving torque of the sprocket wheel 5. The partial drive 18 here is provided as a leading drive and arranged coaxially to the common axis 23 of the plate cylinder 3 and the sprocket wheels 4 and 5.

Figure 3:
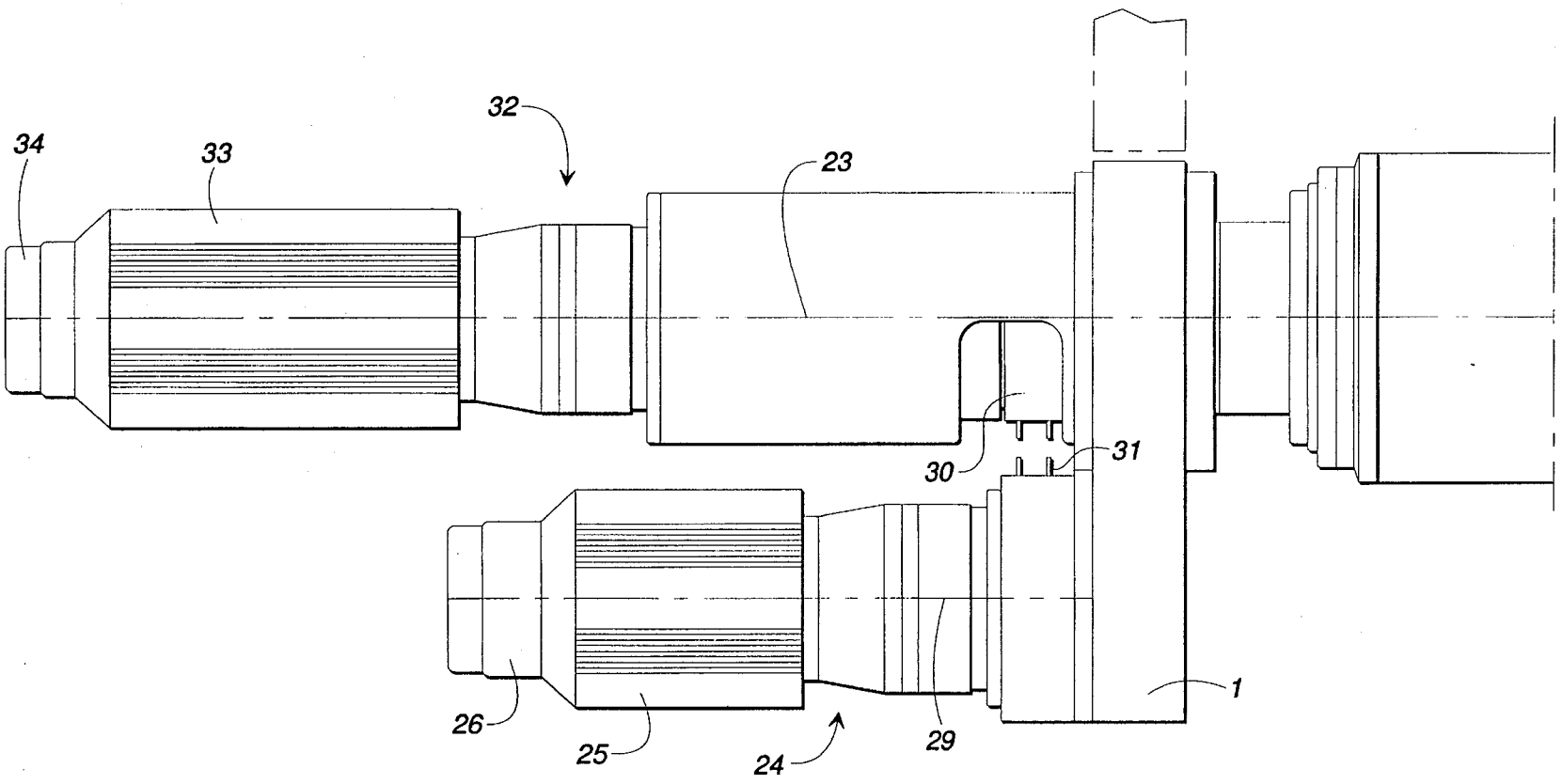

A partial drive 24 is provided and allocated to the sprocket wheel 4 in the same manner as the partial drive 18 is allocated to the sprocket wheel 5. The partial drive 24 comprises a single drive 25 and an encoder 26. A measuring device 27 for determining the instantaneous angular position of the sprocket wheel 4 and a measuring device 28 for determining the instantaneous driving torque of the sprocket wheel 4 are allocated to the partial drive 24. The axis 29 of the partial drive 24 is displaced in parallel at a distance with respect to the axis 23. A transmission gear 30 containing a transmission belt 31 is provided to drive the sprocket wheel 4 over the partial drive 24 in the manner seen in FIGS. 1 and 3.

Coaxially mounted to the axis 23 there is an additional single drive 32 driving the plate cylinder 3 only. This additional single drive 32 comprises a single motor 33 and an encoder 34. The additional single drive 32 also has a measuring device 35 for determining the instantaneous additional driving torque, in which the plate cylinder 3 is driven. A further measuring device 36 on the additional single drive 32 serves for determining the instantaneous driving torque, transmitted from the plate cylinder 3 to the endless belt 11.

Figure 5:
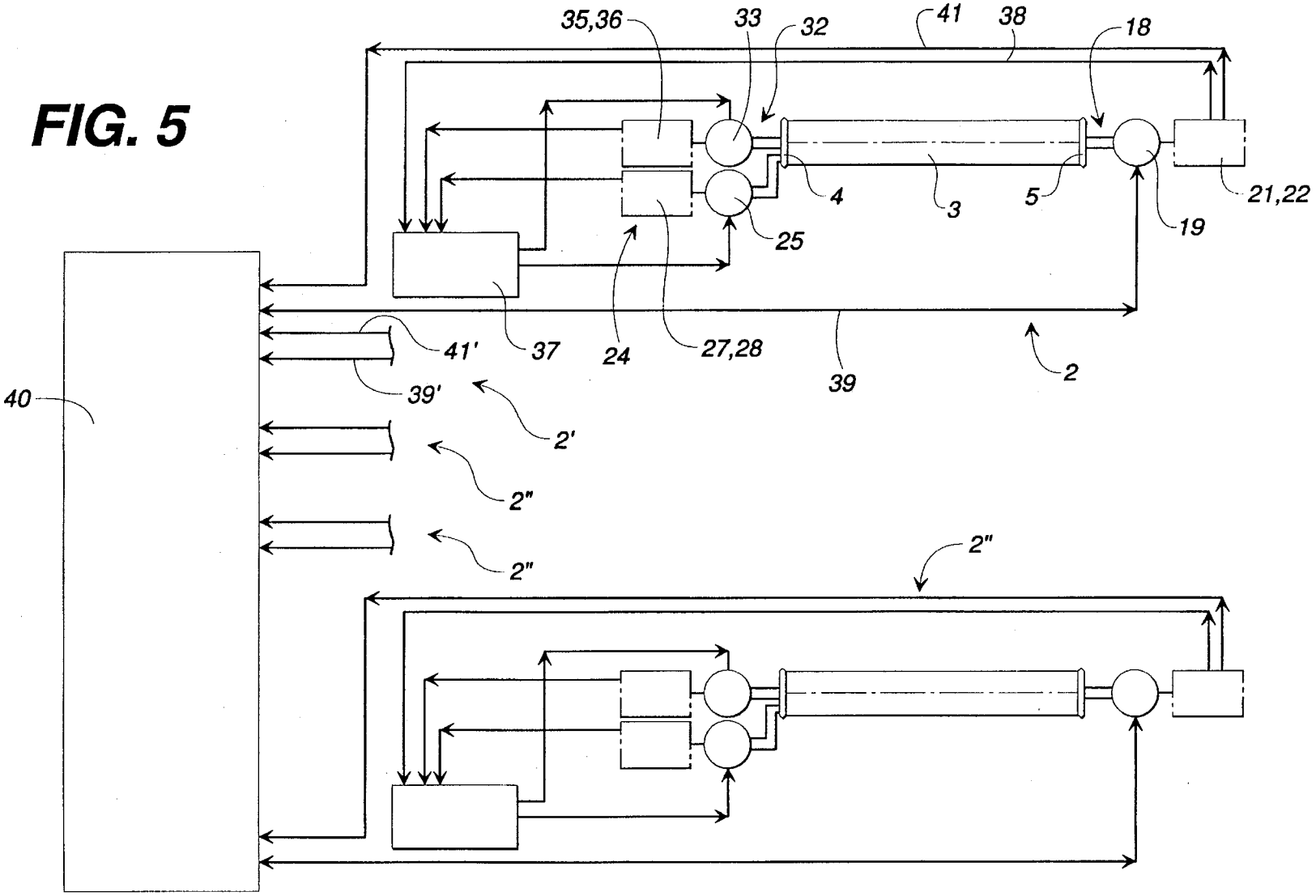

Each of the single motors 25, 33 of the partial drive 24 and the additional single drive 32 are connected to controlling means 37 allocated for the printing station 2, as seen in FIG. 5. An electric wire 38 connects the measuring devices 21 and 22 of the partial drive 18, the leading drive, with the controlling means 37 which then controls the partial drive 24 and the additional single drive 32. An electric wire 39 leads from a controlling means 40 of a higher order for the whole belt-type printing machine to the single drive 19 of the partial drive 18. It is evident that the partial drives 18 and 24 may change their leading function. But it is advantageous to choose the partial drive, which is more precise, as the leading drive, due to the fact that partial drive 18 has no transmission gear to span the distance between the axes in parallel. An electric wire 41 connects the measuring devices 21 and 22 of the partial drive 18 with the controlling means 40 of the higher order. The measuring devices 21, 22, 27, 28, 35, 36 serve to detect the instantaneous angular positions and the instantaneous driving torques. The controlling means 37 of each printing station controls the angular positions and driving torques with respect to each other. The controlling means 40 of the higher order controls the angular positions and the driving torques, with respect to each other, but also the printing speed through the entire belt-type printing machine. For reason of illustration, further wires 39' and 41' of a second printing station are shown. It is to be understood that the further parts have to be provided in the same manner as shown and described with respect to the controlling means and the arrangement of the first printing station. Other printing stations 2', 2", . . . according to the number of printing stations provided, are connected with the controlling means 40 of the higher order, as illustrated in FIG. 5.

LIST OF REFERENCE NUMERALS

| | |
|---|---|
| 1 - frame | 11 - belt |
| 2 - printing station | 12 - supporting arrangement |
| 3 - plate cylinder | 13 - inking assembly |
| 4 - sprocket wheel | 14 - screen roll |
| 5 - sprocket wheel | 15 - doctor blade |
| 6 - impression cylinder | 16 - screen roll |
| 7 - idler roll | 17 - pivoting arm |
| 8 - web | 18 - partial drive |
| 9 - arrow | 19 - single drive |
| 10 - tensioning roll | 20 - encoder |
| 21 - measuring device | 31 - transmission belt |
| 22 - measuring device | 32 - additional single drive |
| 23 - axis | 33 - single drive |
| 24 - partial drive | 34 - encoder |
| 25 - single drive | 35 - measuring device |
| 26 - encoder | 36 - measuring device |
| 27 - measuring device | 37 - controlling means |
| 28 - measuring device | 38 - wire |
| 29 - axis | 39 - wire |
| 30 - transmission gear | 40 - controlling means |
| 41 - wire | |

We claim:

1. A belt-type printing machine, especially for a plurality of colors, comprising at least one printing station (2) containing a frame (1), idler rolls (7) arranged in bearings therein, an impression cylinder (6) for guiding a continuous web (8) to be printed arranged in bearings on the frame (1), a plate cylinder (3), two sprocket wheels (4, 5) coaxially mounted to but not commonly driven with the plate cylinder (3) and at least one tensioning cylinder (10), around which an endless belt (11) extends having at least one flexible printing plate and being provided with perforations for the sprocket wheels (4, 5), wherein an inking assembly (13) allocated to the flexible printing plate of the belt (11), a drive acting upon the sprocket wheels (4, 5) to the belt (11) and an additional single drive (32) acting upon the plate cylinder (3) to the belt (11) for the purpose of avoiding the jump movement between the perforations of the belt and the pins of the sprocket wheels are provided, whereby the two sprocket wheels (4, 5) are idler rollers against each other, the drive of the sprocket wheels (4, 5) is divided into two separately controllable partial drives (18, 24), measuring devices (21, 27, 22, 28) for determining the instantaneous angular positions of the two sprocket wheels (5, 4) against each other and the instantaneous driving torques of the two partial drives (18, 24) are provided, and controlling means (37) for the controlling of driving torques equal to each other via the two partial drives (18, 24) to the sprocket wheels (5, 4) each and, in case of overriding a limit of these equal driving torques, of an additional torque adapted to the amount of overriding and to be transmitted by the additional single drive (32) of the plate cylinder (3) to the endless belt (11).

2. The belt-type printing machine of claim 1, whereby the two partial drives (18, 24) are connected to each other by an electric shaft for the purpose of synchronizing the instantaneous angular positions of the sprocket wheels (5, 4).

3. The belt-type printing machine of claim 1, whereby the two partial drives (18, 24) each comprises a single motor (19, 25), with an encoder (20, 26) each being part of the measuring devices (21, 27) connected for detecting the instantaneous angular positions of the two sprocket wheels (5, 4).

4. The belt-type printing machine of claim 3, whereby a measuring device for detecting the instantaneous current consumption of each of the two single motors (19, 25) is provided as the measuring device (22, 28) for detecting the instantaneous driving torques of the two sprocket wheels (5, 4).

5. The belt-type printing machine of claim 1, whereby one (18) of the two partial drives (18, 24) for the two sprocket wheels (5, 4) is provided as a leading drive for the controlling means (37) and the other partial drive (24) is a follower drive.

6. The belt-type printing machine of claim 5, whereby the partial drive (18) serving as the leading drive is coaxially mounted to the common axis (23) of the sprocket wheels (4, 5) and the plate cylinder (3).

7. The belt-type printing machine of claim 1, whereby the additional single drive (32) for the plate cylinder (3) is coaxially mounted to the common axis (23) of the sprocket wheels (4, 5) and the plate cylinder (3) and comprises a single drive (33), to which an encoder (34) as a part of the measuring device (35) is connected, the partial drive (24) serving as a follower single drive being mounted in parallel and spaced apart from the common axis (23) of the sprocket wheels (4, 5) and the plate cylinder (3).

8. The belt-type printing machine of claim 1, whereby the plate cylinder (3) and/or the tensioning cylinder (10) considerably are made out of carbon fiber material to decrease the diameter and the mass moment of inertia.

9. The belt-type printing machine of claim 1, whereby a controlling means (40) of a higher order is provided for a plurality of printing stations (2), upon which first the encoders (20) of the partial drives (18) serving as leading drives of the printing stations (2), second the encoders (26) of the partial drives (24) serving as follower drives of the printing stations (2) and third the encoders (34) of the additional single drive (32) of the printing stations (2) are connected to each other each.

* * * * *